US006254476B1

(12) United States Patent
Choi

(10) Patent No.: US 6,254,476 B1
(45) Date of Patent: Jul. 3, 2001

(54) AIR CIRCULATING FAN

(75) Inventor: Kyung-Ju Choi, Jefferson, KY (US)

(73) Assignee: AAF International, Inc., Louisville, KY (US)

( * ) Notice: Subject to any disclaimer, the term of this patent is extended or adjusted under 35 U.S.C. 154(b) by 0 days.

(21) Appl. No.: 09/415,448

(22) Filed: Oct. 8, 1999

(51) Int. Cl.[7] ..... F24F 7/06
(52) U.S. Cl. ..... 454/329; 416/223 R
(58) Field of Search ..... 416/223 R; 454/329

(56) References Cited

U.S. PATENT DOCUMENTS

| | | | | |
|---|---|---|---|---|
| 1,991,095 | * | 2/1935 | Hochstetter | 416/223 R |
| 4,722,265 | | 2/1988 | Deckert . | |
| 4,754,697 | | 7/1988 | Asselbergs . | |
| 4,809,593 | | 3/1989 | Asselbergs . | |
| 4,846,399 | | 7/1989 | Asselbergs | 236/49.4 |
| 5,054,380 | | 10/1991 | Hubbard . | |
| 5,320,493 | * | 6/1994 | Shih et al. | 4169/223 R |
| 5,489,238 | | 2/1996 | Asselbergs | 454/329 |
| 5,513,951 | * | 5/1996 | Komoda et al. | 416/223 R |
| 5,632,677 | | 5/1997 | Elkins | 454/329 |
| 5,829,956 | | 11/1998 | Chen | 416/196 A |

* cited by examiner

*Primary Examiner*—Harold Joyce
(74) *Attorney, Agent, or Firm*—Polster, Lieder, Woodruff & Lucchesi

(57) ABSTRACT

In a fan for circulating an air stream in an air-treating environment, an improved fan blade structure designed to optimize airflow along the rotational axis of the fan blade within an optimized low decibel sound range and at preselected revolutions per minute.

27 Claims, 7 Drawing Sheets

AIR CIRCULATING FAN

BACKGROUND OF THE INVENTION

The present invention relates to an air circulating fan and more particularly to a fan for circulating an air stream in an air treating environment.

The heating and cooling art has employed numerous fan arrangements for moving and circulating treated air to preselected locations, often utilizing both primary and auxiliary fan arrangements as specific environmental conditions dictate. Consideration has been given to, but not limited to, such factors as air movement efficiency and the cost thereof, the amount of cubic feet of air to be moved to a given location in a given time period, the sound levels produced by the air moving equipment, the amount of air waste in delivering the desired quantity of air to such given location, and the general complexity and maintenance of the air circulating fan structure involved. Several types of fan structures, particularly in booster fan arrangements have addressed one or more of the aforementioned factors, attention being directed to U.S. Pat. No. 4,722,266, issued to D. D. Deckerton, Feb. 2, 1988, which discloses an auxiliary air-flow boosting device which includes an induction motor, power controlled, driven fan disposed in a specific flow-through housing adapted to be sealed to a primary air source; U.S. Pat. No. 4,754,697, issued to C. K. J. Asselbergs on Jul. 5, 1988, which discloses a housing mounted tangential flow impeller with extendable housing legs; U.S. Pat. No. 4,846,399, issued to C. K. J. Asselbergs on Jul. 11, 1989, which discloses a somewhat similar flow-through boosting device and which concentrates on the fan blade shape at the impeller tips to expel air therefrom in a largely radial direction at 35° to the impeller plane; U.S. Pat. No. 4,809,593, issued to C. K. J. Asselbergs on Mar. 7, 1989, which discloses a flow-through booster device which concentrates on the sealing arrangement with the primary air source; U.S. Pat. No. 5,054,380, issued to E. S. Hubbard on Oct. 8, 1991, which discloses a flow-through housing with radial flow impellers; U.S. Pat. No. 5,489,238, issued to C. K. J. Asselbergs on Feb. 6, 1996, which discloses still another flow-through housing with a centrifugal fan rotor; U.S. Pat. No. 5,632,677, issued to L. V. Elkins on May 27, 1997, which discloses a plurality of venting fans mounted in an outlet register; and, finally to U.S. Pat. No. 5,829,956, issued to Y. Chen et al. on Nov. 3, 1998, which discloses a fan blade assembly with fan blades having different curvatures from the inventive fan blade structure described herein.

None of these above-mentioned fan arrangements however, teaches the unique and novel air circulating fan structure as described herein, the inventive fan structure being capable of being utilized with both primary and booster arrangements in a straightforward, efficient, and economical manner with a minimum of maintenance and with the capability of efficiently delivering a maximum amount of air being moved through a preselected outlet with a minimum of noise and with a minimum of air waste.

Various other features of the present invention will become obvious to one skilled in the art upon reading the disclosure set forth herein.

SUMMARY OF THE INVENTION

More particularly the present invention provides a fan for circulating an air stream in an air treating environment including a substantially circular hub having a plurality of preselected contoured fan blades extending therefrom, each blade having an air stream leading and trailing edge and including a root portion adjacent the outer peripheral wall of the hub and a spaced distal tip portion, each blade including preselectively contoured air stream inlet and air stream outlet faces with selected portions of each blade disposed at preselected angles to an imaginary plane passing normally through the rotational axis of the hub, each root portion of each blade being at a preselectively substantially greater angle to such imaginary plane adjacent the root portion thereof than at the tip portion with the air stream outlet face of each blade being so contoured that imaginary curvature arcs taken substantially parallel to the outer peripheral wall of the hub on the air stream outlet face of the blade between the leading and trailing blade edges varying in length from blade root portion to blade tip portion with an imaginary curvature arc taken substantially adjacent the tip portion being of the greatest length whereby the major portion of the air stream emanating from the air stream outlet face of each blade flows substantially parallel the rotational axis of the hub.

It is to be understood that various changes can be made by one skilled in the art in one or more of the several parts of the structure disclosed herein without departing from the scope or spirit of the present invention. For example, the length, width and curvature of the fan blade can be proportionally varied within defined limits indicated herein depending upon the environment in which the air circulation features of the novel fan structure is to be utilized. Further, the dimensions and features of a flow-through booster housing can be varied within the defined limits of fan variation, when a booster housing such as disclosed is required.

BRIEF DESCRIPTION OF THE DRAWINGS

FIG. 4*a* is a projected, cross-sectional view of the blade of the fan of FIG. 4 taken in a plane through 4*a*—*a* of FIG. 4; through approximately the middle portion of a blade between the blade root portion and blade tip portion;

DETAILED DESCRIPTION OF THE DRAWINGS

Figure 1:
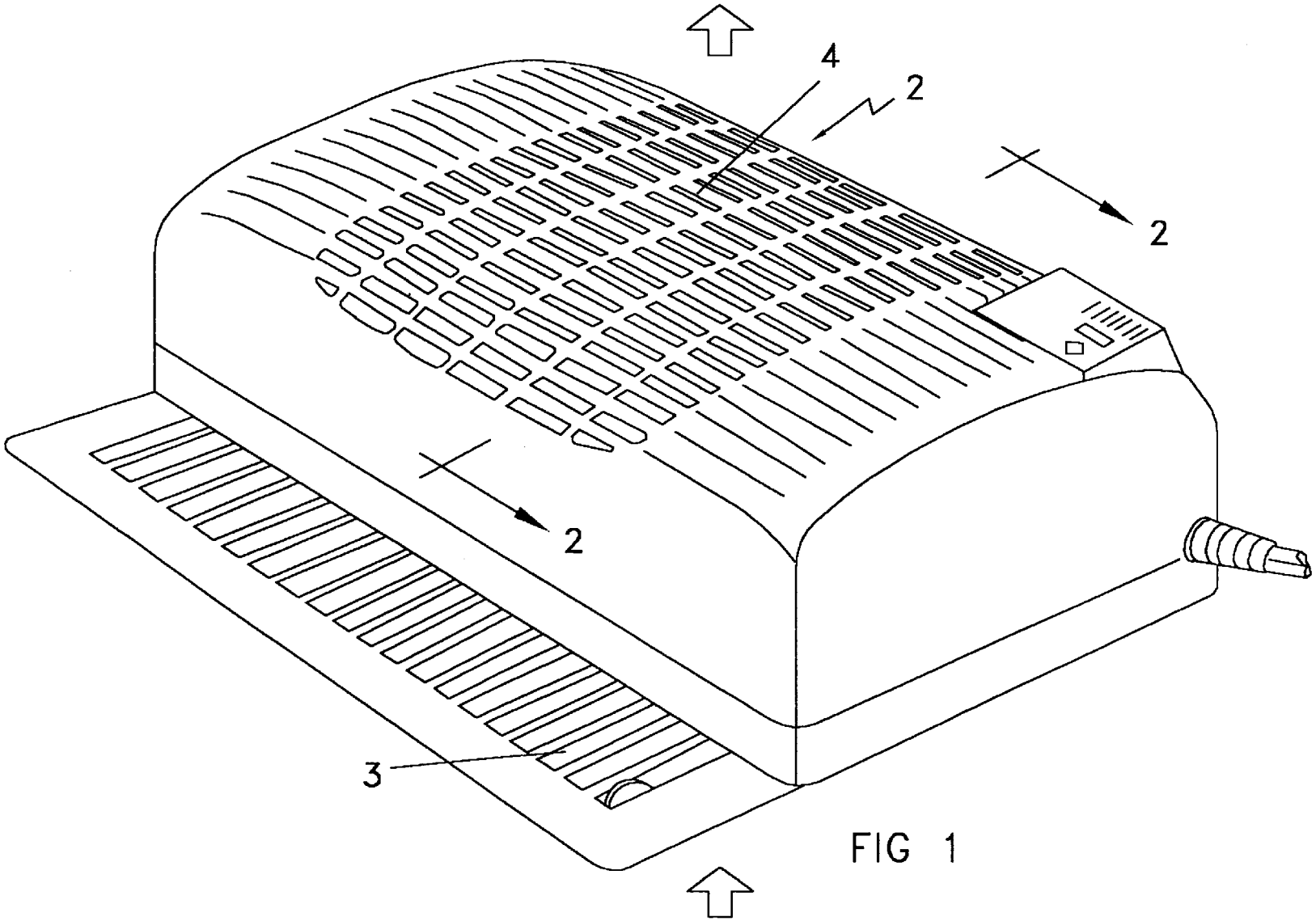
FIG. 1 is an isometric view of a flow-through booster fan housing incorporating the novel air circulating fan, the housing being positioned above the outlet of an air flow vent.
Figure 2:
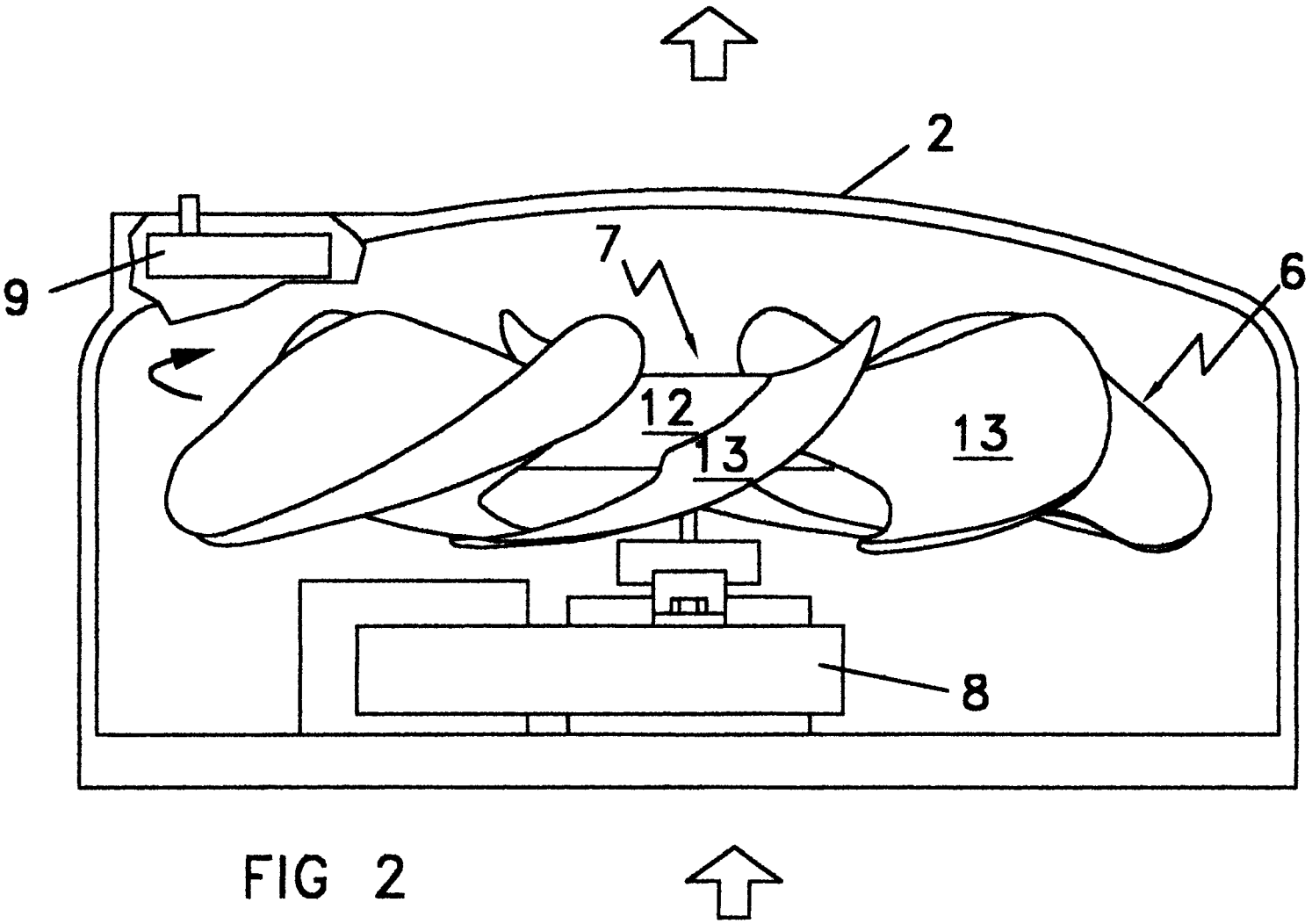
FIG. 2 is a schematic, cross-sectional side view of the structure of Figure, taken in plane through line 2—2 of FIG. 1, disclosing a side view of the inventive air circulating fan, the electric drive motor therefor, and the thermostatic control switch-all of which are disposed in the booster housing of FIG. 1.

Referring to FIGS. 1 and 2 of the drawings, a portable rectangular flow-through air stream booster unit housing 2 is disclosed positioned adjacent an air stream vent 3. The bottom open inlet of housing 2 is sized and shaped to fit over vent 3 in sealed relation therewith to receive and boost the flow of an air stream emanating therefrom. Suitable sealing material (not shown but known in the art) can be provided between the bottom perimeter of booster housing 2 and the perimeter of vent 3 to avoid air stream leakage therebetween.

As also is known in the art, the rectangular flow-through shell of housing 2 (FIG. 1) can be formed from a suitable durable material, such as, but not limited to, any one of several plastics, including acrylonitrile butadiene styrene (ABS). The shell of housing 2 as disclosed includes a substantially rectangularly shaped air stream outlet 4 in the form of rows of spaced slots, the outlet being sized to accommodate the air stream flow emanating from inventive fan blade structure 6 disposed in housing 2 (FIG. 2) as part of an electrically powered fan structure 7 which also includes a fan powering electric motor 8 and thermostatic temperature responsive switch 9.

Figure 3:
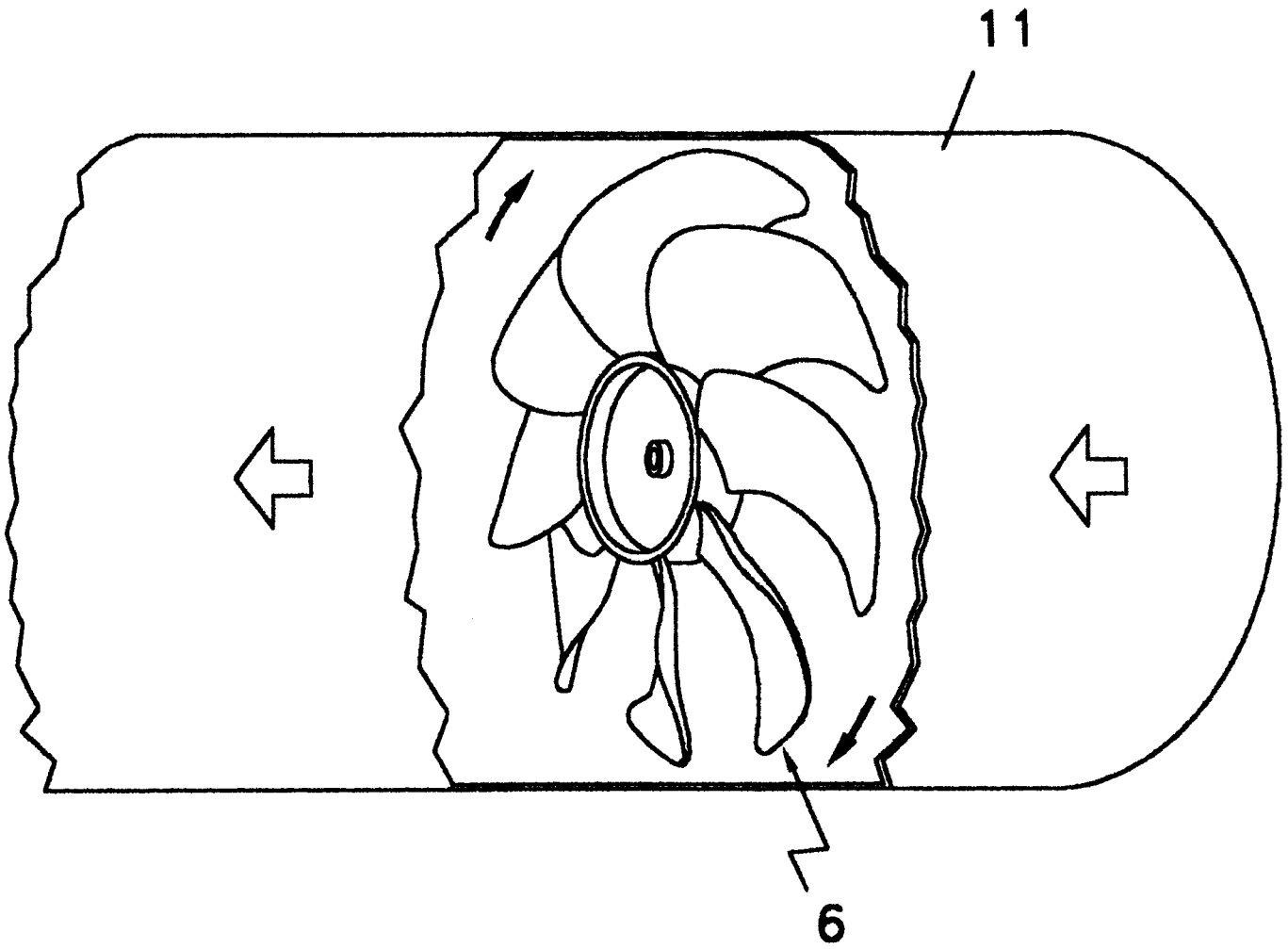
FIG. 3 is a partially broken away isometric view of the inventive air circulating fan disposed in an air stream conduit.

It is to be noted in FIG. 3 of the drawings, that the inventive blade structure 6 is not to be considered as limited to use with only a booster housing 2 but can be used in any one of a number of places where an air stream is to be moved in a straight-forward and economical manner with a minimum of operational steps and a minimum of maintenance. In FIG. 3, the inventive fan blade structure 6 is disclosed as disposed in a correspondingly sized duct portion 11 which communicates with any one of several air flow outlets (not shown).

Figure 4:
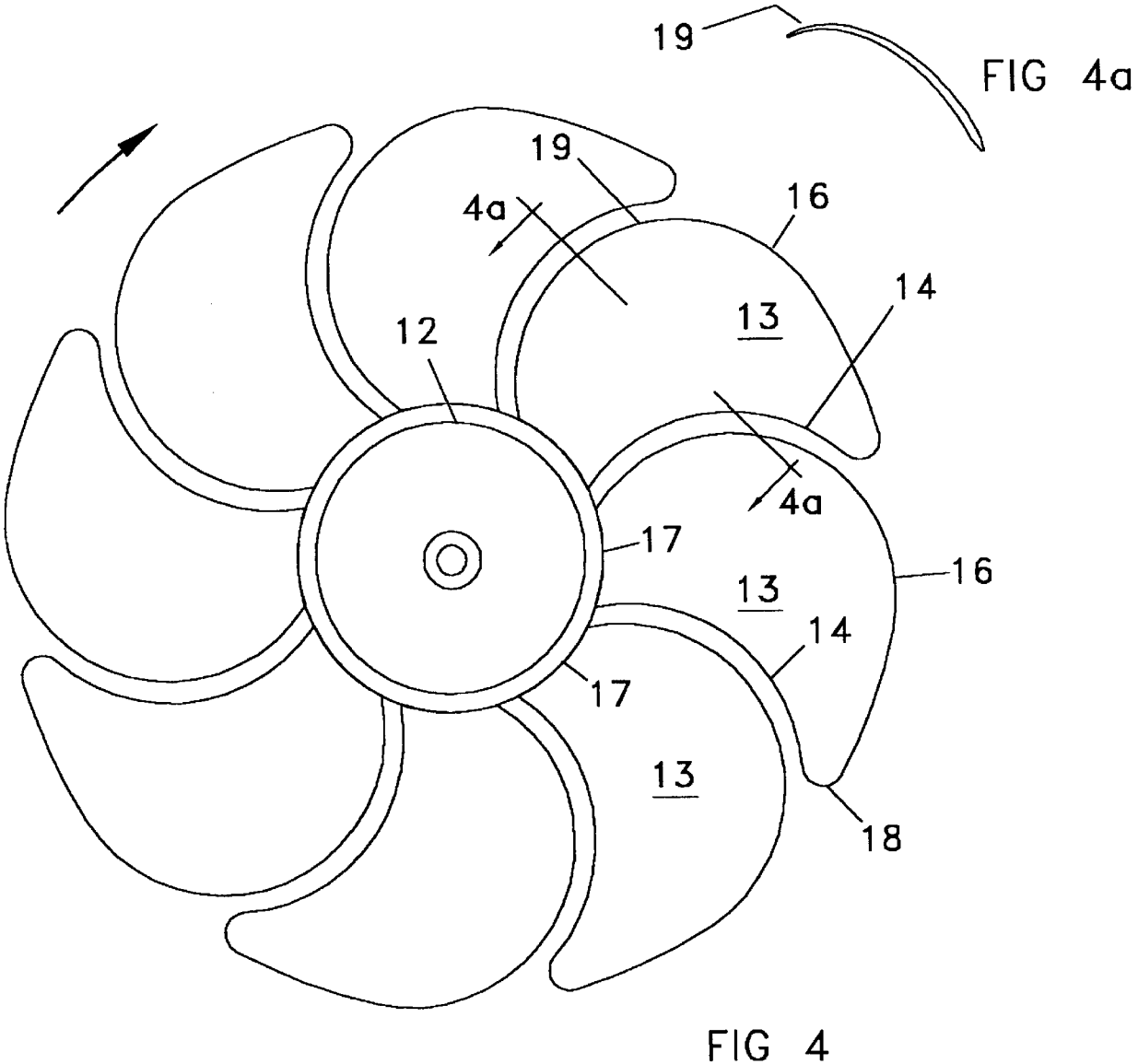
FIG. 4 is an enlarged top plan view of the inventive air circulating fan blade disclosed in FIGS. 2 and 3.
Figure 5:
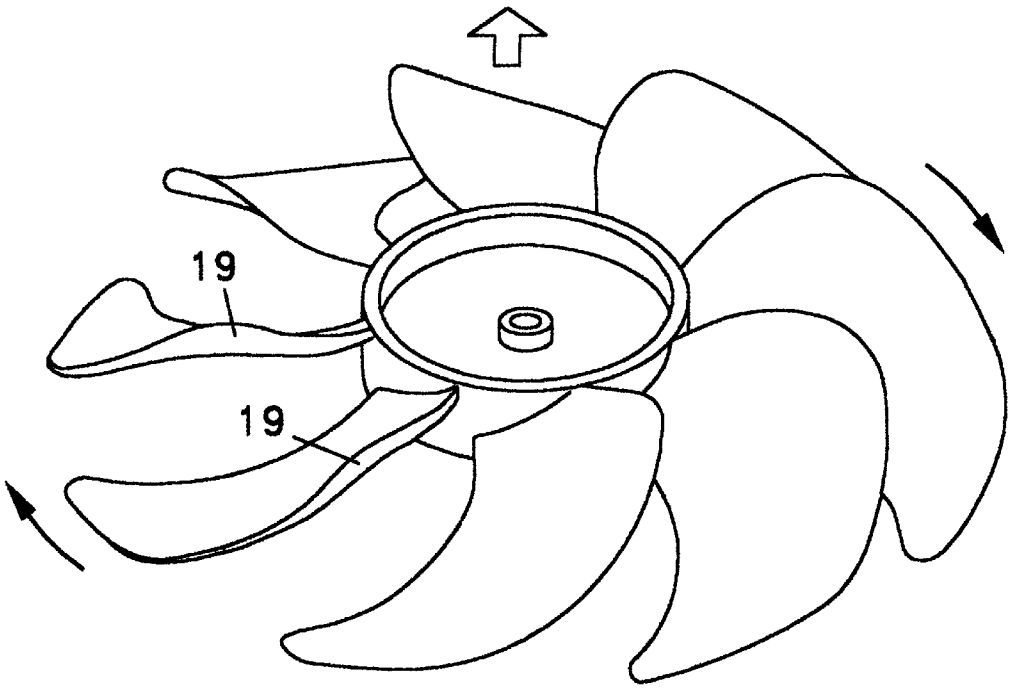
FIG. 5 is another enlarged isometric view of the inventive fan structure of FIGS. 2–5.
Figure 6:
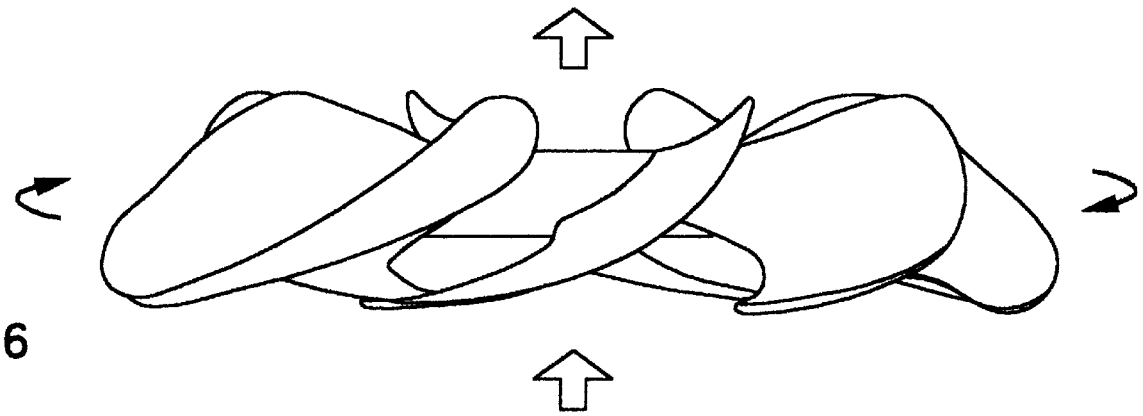
FIG. 6 is a side view of the enlarged fan structure of FIG. 5.

Referring to FIGS. 4–6 of the drawings which disclose the outlet face of inventive fan structure 6 in more detail, it can be seen that fan structure 6 includes a substantially circular hub 12 with preselectively contoured fan blades 13 fastened to and extending from the outer peripheral wall of hub 12. In the embodiment disclosed eight (8) blades 13 extend from the outer peripheral wall of hub 12, however, it is to be understood that the number of blades utilized can be varied in number depending upon the air flow demands to be met by the inventive fan structure. In the embodiment of FIG. 4, the outlet face of each inventive blade 13 is shown as rotating in a clockwise fashion and includes a leading edge 14 and a trailing edge 16 with inlet and outlet surface faces therebetween disposed between a root portion 17 adjacent the outer peripheral wall of circular hub 12 and a distal end tip portion 18. As can be observed in FIG. 4 and 5 of the drawings, each blade 13 is so contoured that imaginary spaced parallel curvature arcs taken cross-sectionally of the blade and substantially parallel to the outer peripheral wall of hub 12 on the air stream outlet face of each blade 13 between the leading edge 14 and trailing edge 16 vary in substantially increasing length from root portion 17 to tip portion 18 with an imaginary cross-sectional curvature arc taken substantially adjacent blade tip portion 18 being of the greatest length. Referring to FIGS. 5 and 6 of the drawings, it is to be noted that the outlet surface root portion 17 of each blade is disposed to an imaginary plane passing normally through the rotational axis of the hub 12 at a substantially greater angle than the outlet surface tip portion 18. Preferably, such angle to the imaginary normal plane at the outer surface root portion is in the approximate range of fifteen to forty (15–40) degrees and advantageously at an angle of approximately thirty-two (32) degrees. The outlet surface tip portion 18 of each blade on the other hand is disposed to such imaginary plane normal to the hub at a much lesser angle in the approximate range of two to ten (2–10) degrees and advantageously at an angle of approximately six (6) degrees to such plane.

Again referring to FIG. 4 of the drawings, it is to be noted that the major portion of the leading edge 14 and the trailing edge 16 of each blade 13 is of approximately semicircular concave contour from a top view in the clockwise rotational direction of each blade with the leading edge 14 being of larger concave semicircular shape than the trailing edge 16. It further is to be noted in FIG. 4 that a slight preselected space is allowed between the trailing edge 16 of one blade 13 and the leading edge 14 of the next successive blade. Not only does such preselected spacing provide for an aerodynamic advantage to reduce possible air flow turbulence between blades but, in addition, it allows for the ready removal of each blade from a forming mold. In this regard, each blade can be mold-formed from any one of a number of suitable plastic materials including, but not limited to, nylon, polycarbonate or polyolefins. It is to be understood that the number and spacing of the blades 13 around hub 12 can be varied in accordance with air flow environmental demands and, in some instances, where aerodynamics indicates, the leading and trailing edges of successive blades can be arranged in a preselectively overlapping position.

Referring to FIGS. 4*a* and 5 of the drawings, it can be seen that the approximate middle portion 19 of the outlet surface of only the trailing edge of each blade 13 between root portion 17 and tip portion 18 can be inclined at an angle to the aforementioned imaginary plane normal to hub axis 12, which inclined angle is in the approximate range of twenty-five to sixty (25–60) degrees to such imaginary plane and advantageously at the approximate range of forty-six (46) degrees.

The above described inventive fan structure arrangement can be designed to rotate in a speed range of approximately five hundred to four thousand (500–4000) revolutions per minute (rpm) and advantageously in the approximate range of fifteen hundred to nineteen hundred (1500–1900) revolutions per minute (rpm), delivering an approximate air stream volume of eighty-three (83) cubic feet per minute with at least ninety-five (95) and up to ninety-nine (99) percent (%) of this volume passing through the outlet 4 of booster housing 2.

In a typical booster housing 2, the substantially rectangular housing measures approximately a foot (12") in length and one half foot (6") in width with a width curved centered and grilled outlet surface measuring approximately six (6) inches in length and approximately six (6) inches in width. The fan structure itself measures approximately five point four (5.4) inches in diameter with a hub diameter of approximately one and three fourths (1¾) inches. Referring to FIG. 4*a*, an imaginary cross-sectional arc extending along the trailing edge 16 of each blade 13 substantially between the entirety of the distance between the root portion 17 and tip portion 18 would measure in thickness at approximately the center of the cross-section along the inclined trailing edge three sixty fourths (3/64) of an inch and adjacent the root and tip portions approximately two thirty seconds (2/32) of an inch.

Figure 7:
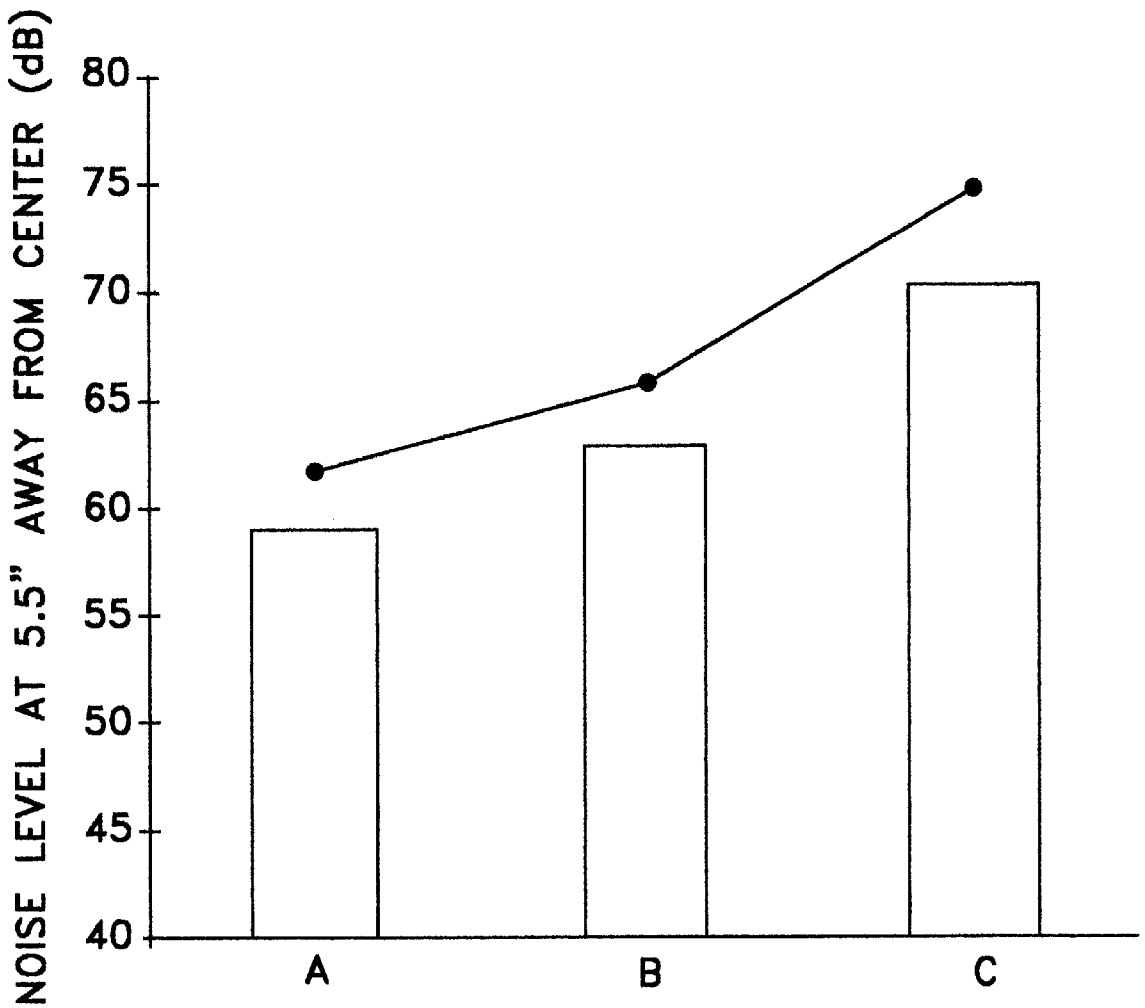
FIG. 7 is a comparative sound graph, disclosing the decibel level of the inventive fan structure "A" when compared with decibel levels of two known fan structures "B" and "C" presently available on the commercial market with noise level measurement conditions being identical for each fan; and, FIG. 8 is a comparative air velocity curve in feet per minute (ft./min.) for the above three competitive fans with velocity level measurement conditions being identical for each fan.

Referring to FIG. 7 of the drawings a comparative decibel sound level bar graph is shown comparing fan structure sound levels measured under equal measuring conditions and at the same blade levels for three fan structures, "A", "B" and "C" at five point five (5.5) inches away from the central outlet surface of each fan structure "A", "B" and "C", the three fan structures rotating equally at eighteen hundred revolutions per minute (1800 rpm) without a housing present. The bar "A" represents the inventive fan structure and the bars "B" and "C" representing fan blade structures of two competitive manufactures in the market place. As can be seen in the bar graph, the inventive fan structure "A" is between fifty-five (55) and sixty (60) quiet level decibels (dB), whereas the competitive bar "B" measurement is approximately a noisier sixty three (63) decibel (dB) measurement and competitive bar "C" measurement is even a noisier decibel measurement above seventy (70) decibels (dB).

Similar competitive sound level measurements were taken with housings in place for each fan structure, as shown by the filled circles of FIG. 7 with similar competitive results, the inventive structure "A": being at approximately sixty-two (62) decibels, competitive structure "B" being at the noisier level of approximately sixty-six (66) decibels and competitive structure "C" being at even a noisier level of approximately seventy-five (75) decibels.

Figure 8:
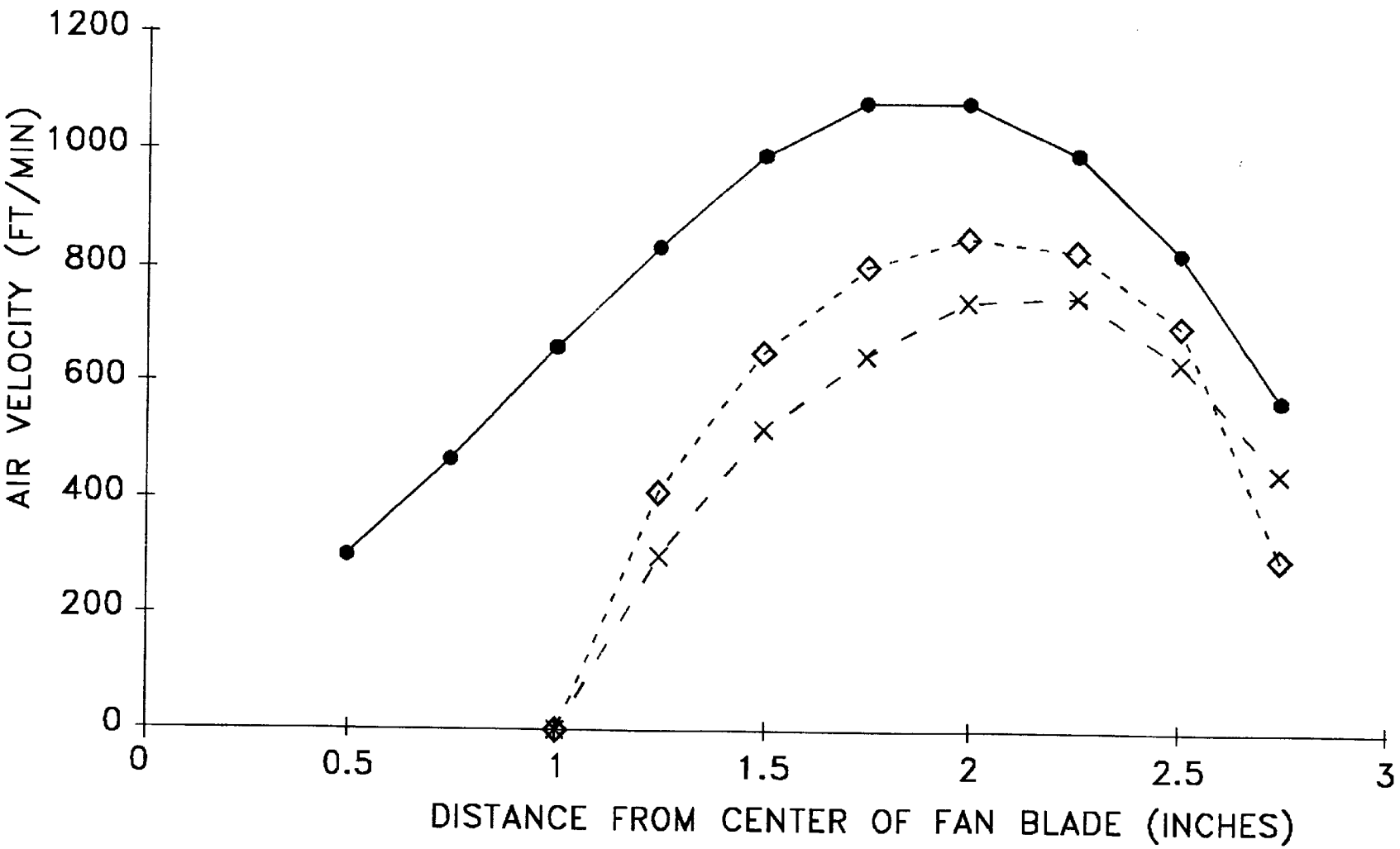

Referring to FIG. 8 of the drawings, a competitive air velocity curve graph is shown comparing air velocities measure under equal conditions for the same three fan structures "A", "B" and "C". The air velocity curve of the inventive fan structure is shown in joined filled black circles, the air velocity curve for the competitive "B" fan structure is shown in joined open diamonds and the air velocity curve for the competitive "C" fan structure is shown in joined crosses. It will be readily evident from this graph that the air velocity (f/min) efficiency of the inventive "A" fan structure is well above that of competitive fan structures "B" and "C".

In effect, the inventive "A" fan structure was found to deliver airflow throughout the grilled outlet area of the housing at approximately eighty-three (83) cubic feet per minute (cfm), competitive fan "B" to deliver air at approximately forty-six (46) cubic feet per minute (cfm) and competitive fan "C" to deliver air at forty-two (42) cubic feet per minute (cfm). The inventive "A" fan structure delivering a substantially greater air flow volume and yet remaining quieter than the other two competitive fan structures "B" and "C".

The invention claimed is:

1. In a fan for circulating an air stream in an air treating environment, a substantially circular hub having a plurality of preselected contoured fan blades extending therefrom, each blade having an air stream leading and trailing edge and including a root portion adjacent the outer peripheral wall of said hub and a spaced distal tip portion, each blade including preselectively contoured air stream inlet and air stream outlet faces with selected portions of each blade disposed at preselected angles to an imaginary plane passing normally through the rotational axis of said hub, each root portion of each blade being at a preselectively substantially greater angle to said imaginary plane adjacent said root portion thereof than at said tip portion with said air stream outlet face of each blade being so contoured that imaginary curvature arcs taken substantially parallel to said outer peripheral wall of said hub on said air stream outlet face of said blade between said leading and trailing blade edges varying in length from blade root portion to blade tip portion with an imaginary arc taken substantially adjacent said tip portion being of the greatest length whereby the major portion of said air stream emanating from said air stream outlet face of each blade flows substantially parallel said rotational axis of said hub.

2. The fan structure of claim 1, each of said blades including contoured means cooperative with said air stream outlet face to enhance air stream flow along the rotational axis of said hub.

3. The fan structure of claim 2, said contour means extending along said trailing edge of said blade between said root portion and said tip portion.

4. The fan structure of claim 3, said contour means being positioned along the middle portion of said trailing edge between said root portion and said tail portion of said trailing edge of said blade.

5. The fan structure of claim 4, wherein said trailing edge is inclined at a preselected angle to said imaginary plane passing normally through the rotational axis of said hub in the approximate range of twenty-five to sixty (25–60) degrees.

6. The fan structure of claim 5, wherein said trailing edge advantageously is inclined at an approximate angle of forty-six (46) degrees.

7. The fan structure of claim 1, wherein said root portion of said blade is disposed to said imaginary plane passing normally through the rotational axis of said hub of angle in the range of approximately fifteen to approximately forty (15–40) degrees.

8. The fan structure of claim 2, wherein said root portion of said blade is disposed to said imaginary plane passing normally through the rotational axis of said hub at an advantageous angle of approximately thirty-two (32) degrees.

9. The fan structure of claim 1, wherein said tip portion of said blade is disposed to said imaginary plane passing normally through the rotational axis of said hub at an angle in the range of approximately two to ten (2–10) degrees.

10. The fan structure of claim 9, wherein said tip portion of said blade is disposed to said imaginary plane passing normally through the rotational axis of said hub advantageously at an angle in the range of approximately six (6) degrees to said plane.

11. The fan structure of claim 1, wherein said root portion of said blade is disposed to said imaginary plane passing normally through the rotational axis of said hub at angle in the range of approximately fifteen to forty (15–40) degrees and said tip portion is disposed to said imaginary plane at an angle in the range of approximately two to ten (2–10) degrees.

12. The fan structure of claim 11, wherein said angles of disposition to said imaginary plane are advantageously approximately thirty-two (32) degrees at the root portion and advantageously approximately six (6) degrees at the tip portion.

13. The fan structure of claim 1, wherein the major portion of said leading and trailing edges of each of said blades are of approximately semicircular concave contour in a clockwise rotational direction of said blade with said semicircular leading edge portion being of larger semicircular shape than said trailing edge portion when taken from a top view of each of said blades.

14. The fan structure of claim 1, wherein said blades are capable of rotation in the range of five hundred to four thousand (500–4000) revolutions per minute (rpm).

15. The fan structure of claim 14, wherein said blades are designed to optimally rotate in the approximate range of fifteen to nineteen hundred (1500–1900) revolutions per minute (rpm), delivering an air stream from said blade outlet faces at the rate of approximately eighty-three (83) cubic feet per minute (cfm).

16. The fan structure of claim 1, whereby said major portions of said air stream emanating from said air outlet faces of each blade parallel said rotational axis of said hub is in the range of approximately ninety-five (95) to ninety-nine (99) percent (%).

17. The fan structure of claim 1, wherein the trailing edge of each blade is slightly spaced from the leading edge of a successive blade.

18. The fan structure of claim 1, said fan structure being formed from a preselected mold material.

19. The fan structure of claim 18, said mold material being nylon.

20. The fan structure of claim 18, said mold material being polycarbonate.

21. The fan structure of claim 18, said mold material being polyolefins.

22. The fan structure of claim 1, said fan having a noise level when sound measured at the same fan level and approximately five point five (5.5) inches from said axis of rotation of said fan is in the approximate quite range of fifty-five (55) to sixty-five (65) decibels.

23. The fan structure of claim 1, said fan being comprised of at least eight (8) blades with an overall fan diameter in the range of approximately five point four (5.4) inches, and a hub diameter in the range of approximately one and three fourths (1.75) inches.

24. The fan structure of claim 1, said fan being disposed in a flow-through housing having an air stream inlet and an air stream outlet sized to accommodate the major portion of said air stream emanating from the outlet face of each fan blade.

25. The fan structure of claim 24, said housing being in flow-through duct shape form sized in diameter to accommodate said fan.

26. The fan structure of claim 24, said housing being a substantially rectangular flow-through unit sized to accommodate an electric fan power motor and thermostatic switch in circuit therewith.

27. A portable rectangular flow-through air stream booster unit including a rectangular flow-through plastic housing having an air stream inlet along the lower portion thereof sized to communicate with an air treatment outlet, and to accommodate an electrically powered fan structure including a fan powering electric motor and thermostatic switch in circuit therewith, said flow through housing having an air stream outlet sized to accommodate an air stream emanating from said fan structure, said fan structure including a substantially circular plastic hub having at least eight plastic preselectively contoured fan blades extending therefrom, each blade having air stream leading and trailing edges with air stream inlet and outlet surface faces therebetween disposed between root portion adjacent the outer peripheral wall of said circular hub and a distal end tip portion, each of said blades being so contoured that imaginary curvature arcs taken substantially parallel to said outer peripheral wall of said hub on said air stream outlet face of each of said blades between said leading and trailing edge thereof vary in length from said blade root to said blade tip portion with an imaginary arc taken substantially adjacent said blade tip portion being of the greatest length, the outer surface root portion of each of said blades being disposed to an imaginary plane passing normally through the rotational axis of said hub at an advantageous angle of thirty-two (32) degrees and the outer surface tip portion at an angle of six (6) degrees to said imaginary plane, the major portion of said leading and trailing edges of each of said blades from a top view thereof being of approximately semicircular concave contour in a clockwise rotational direction of said blade with said leading edge being of larger semicircular shape than said trailing edge, a major portion of said trailing edge of each blade being inclined along the middle portion of said trailing edge between said tip and root portions at an angle of approximately forty-six (46) degrees to said imaginary plane passing normally through said rotational axis along the outlet face of said blade, said blades each being designed to rotate optimally between fifteen hundred to nineteen hundred (1500–1900) revolutions per minute (rpm), delivering an air stream at the rate of approximately eighty-three (83) cubic feet per minute with at least ninety-five (95) percent of said air stream emanating from said outlet faces of said blades passing through said housing outlet in a sound decibel range of fifty-five (55) to sixty-five (65) decibels, said fan structure including blades and hub mold formed from nylon with the trailing edge of each blade being slightly spaced from the next successive blade leading edge to permit mold blade removal and to enhance air stream flow performance.

* * * * *